US011155454B2

(12) United States Patent
Eda et al.

(10) Patent No.: US 11,155,454 B2
(45) Date of Patent: Oct. 26, 2021

(54) CONTAINER PROCESSING SYSTEM

(71) Applicant: SHIBUYA CORPORATION, Kanazawa (JP)

(72) Inventors: Masaaki Eda, Kanazawa (JP); Kazuki Takashima, Kanazawa (JP); Naoya Washi, Kanazawa (JP)

(73) Assignee: SHIBUYA CORPORATION, Kanazawa (JP)

( * ) Notice: Subject to any disclaimer, the term of this patent is extended or adjusted under 35 U.S.C. 154(b) by 22 days.

(21) Appl. No.: 16/750,284

(22) Filed: Jan. 23, 2020

(65) Prior Publication Data

US 2020/0255275 A1 Aug. 13, 2020

(30) Foreign Application Priority Data

Feb. 7, 2019 (JP) ..... JP2019-020948

(51) Int. Cl.
*B67C 7/00* (2006.01)

(52) U.S. Cl.
CPC ..... *B67C 7/0013* (2013.01); *B67C 7/002* (2013.01); *B67C 2007/006* (2013.01)

(58) Field of Classification Search
CPC ..... B67C 7/002; B67C 7/004; B67C 7/0013; B67C 7/0073; B67C 2007/006
See application file for complete search history.

(56) References Cited

U.S. PATENT DOCUMENTS

2016/0264361 A1* 9/2016 Clusserath ..... B67C 7/0046
2019/0256336 A1* 8/2019 Takaku ..... B65B 55/10

FOREIGN PATENT DOCUMENTS

JP 08-000599 B2 1/1996

* cited by examiner

*Primary Examiner* — Jason K Niesz
(74) *Attorney, Agent, or Firm* — Flynn Thiel, P.C.

(57) ABSTRACT

A container processing system includes a filling apparatus and a sterilization apparatus, the filling apparatus including first processing units adapted to process a container held by a gripper at stop positions with a sixth rotating body being rotated while intermittently stopped, the sterilization apparatus including a servomotor adapted to stop the container held by a gripper at an appropriate processing position by driving a second rotating body. During one intermittent motion of the filling apparatus, the sterilization apparatus rotates the gripper of the second rotating body once and thereby moves the gripper from a receiving position for the container to the processing position, stops the gripper there, and then moves the gripper to a transfer position.

4 Claims, 8 Drawing Sheets

CONTAINER PROCESSING SYSTEM

BACKGROUND OF THE INVENTION

Field of the Invention

The present invention relates to a container processing system, and more particularly, to a container processing system having processing apparatuses equipped with rotating bodies adapted to move holding units holding containers while intermittently stopping the holding units.

Description of the Related Art

Conventionally known container processing systems adapted to fill containers with a beverage or the like include one that has a rotating body equipped with plural holding units arranged at equal intervals on a perimeter to hold containers, and performs a process such as filling containers held by the holding units with a beverage while intermittently stopping the holding units at plural processing positions (Japanese Patent Publication No. 8-599).

Such a container processing system is configured such that with the rotating body intermittently stopping the holding units, a filling unit and a processing unit such as a capper process the containers.

Here, in a container processing system such as described in Japanese Patent Publication No. 8-599, the time required for one intermittent motion in which each holding unit moves from one processing position to an adjacent processing position before stopping needs to be set based on the longest of processing times taken by processing units.

In the case of aseptic filling with a beverage, it is necessary to sterilize each container before the filling, and it is known that procedures for such a sterilization process involve first ejecting sterilization gas into the container, then ejecting hot air into the container, and thereby activating the sterilization gas.

To activate sterilization gas effectively, it is necessary to eject hot air promptly after ejection of the sterilization gas, but when plural processing positions are provided for one rotating body as with Japanese Patent Publication No. 8-599, since the holding units move every time one intermittent motion is performed as described above, there is a problem in that it is not possible to perform processing by moving to a next processing position promptly.

In this way, depending on differences in processing time among processing positions, it may not be possible to set these processing positions on one rotating body operating intermittently, and thus, there is demand for a container processing system capable of performing processes differing in processing time in synchronization.

In view of the above problem, the present invention provides a container processing system capable of performing processes in synchronization with each other even if the processes differ from one another in processing time.

SUMMARY OF THE INVENTION

There is provided a container processing system comprising: a main processing apparatus; and a secondary processing apparatus, wherein: the main processing apparatus includes: a main rotating body equipped with a plurality of first holding units arranged at equal intervals on a perimeter to hold containers, a driving unit adapted to rotate the main rotating body while intermittently stopping the main rotating body to intermittently stop the first holding units at a plurality of stop positions, and a first processing unit provided at at least one of the plurality of stop positions and adapted to process the containers held by the first holding units. The secondary processing apparatus includes a secondary rotating body equipped with a second holding unit on a perimeter to hold a container, a servomotor adapted to drive the secondary rotating body and thereby stop the second holding unit at an appropriate processing position, and a second processing unit adapted to process the container held by the second holding unit at the processing position. On the secondary processing apparatus, after the container held by the second holding unit of the secondary rotating body is processed by the second processing unit, the container is transferred to one of the first holding units of the main rotating body of the main processing apparatus and the first processing unit processes the container while the main rotating body rotates and moves the container intermittently. While the main processing apparatus performs one intermittent motion during which the main rotating body stops the first holding unit at a stop position in which the first processing unit is placed and the first processing unit processes the container held by the first holding unit and the main rotating body moves the first holding unit to an adjacent stop position and stops the first holding unit at the adjacent stop position, the secondary processing apparatus causes the second holding unit of the secondary rotating body to rotate once, and in the meantime, performs an operation of moving the second holding unit of the secondary rotating body from a container receiving position to a processing position for the second processing unit and stopping the second holding unit, an operation of processing the container at the processing position using the second processing unit, and an operation of moving the second holding unit of the secondary rotating body from the processing position to the container transfer position.

While in the main processing apparatus, the holding units are moved by the main rotating body while intermittently stopped, by driving the secondary rotating body of the secondary processing apparatus using the servomotor, the invention allows the holding unit of the secondary processing apparatus to move independently of the intermittent movement of the holding units of the main processing apparatus.

On the other hand, since the secondary processing apparatus receives and transfers the container by making the secondary rotating body rotate once during one intermittent motion of the main processing apparatus, the main processing apparatus and secondary processing apparatus operate in synchronization with each other.

That is, the container processing system according to the present invention can perform processes differing in processing time in synchronization using the main processing apparatus and secondary processing apparatus.

DETAILED DESCRIPTION OF THE PREFERRED EMBODIMENTS

Figure 1:
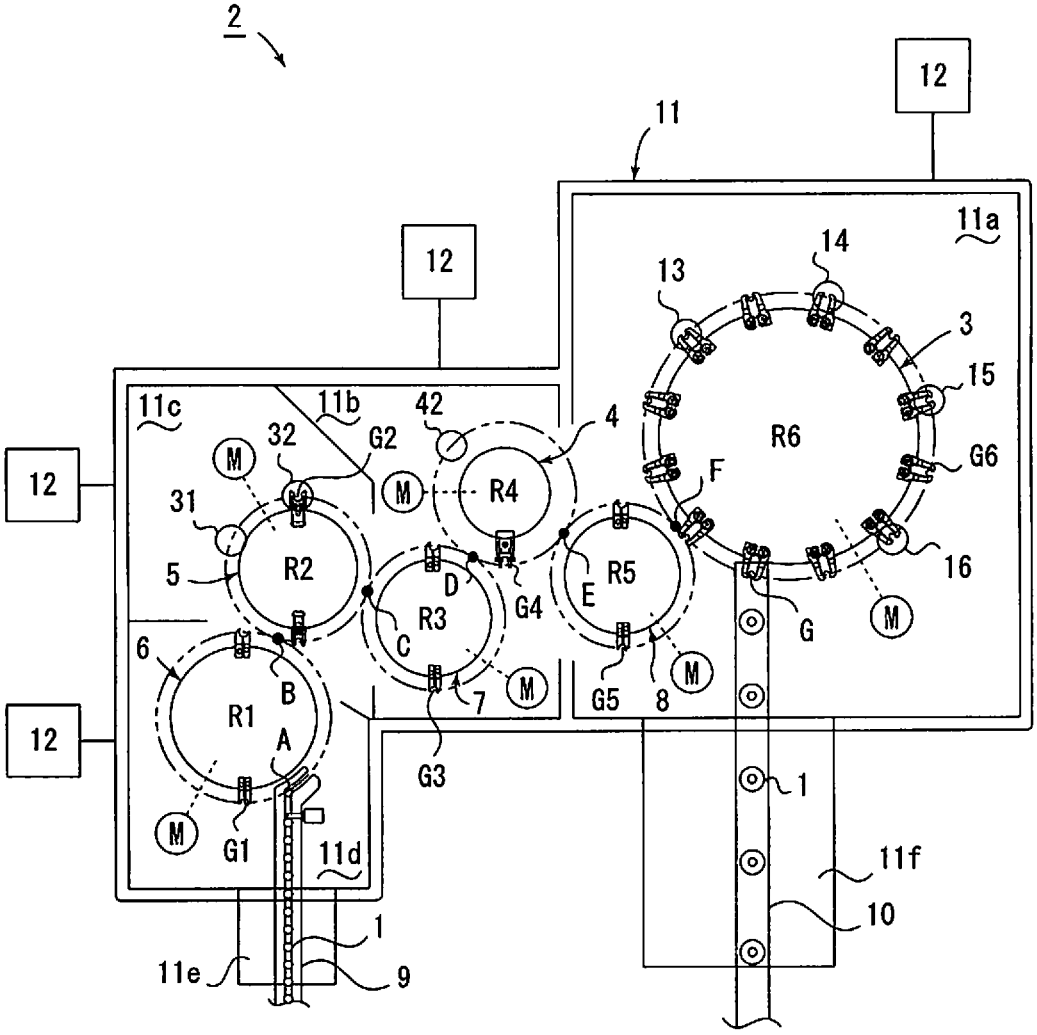
FIG. 1 is a configuration diagram of a container processing system according to an embodiment of the present invention.

An illustrated embodiment will be described below. FIG. 1 shows a container processing system 2 adapted to fill a container 1 with a beverage. In particular, the container processing system 2 according to the present embodiment is capable of filling containers 1 with a beverage in a process similar to a process on a production line for mass production and is suitable for small lot production.

Figure 3:
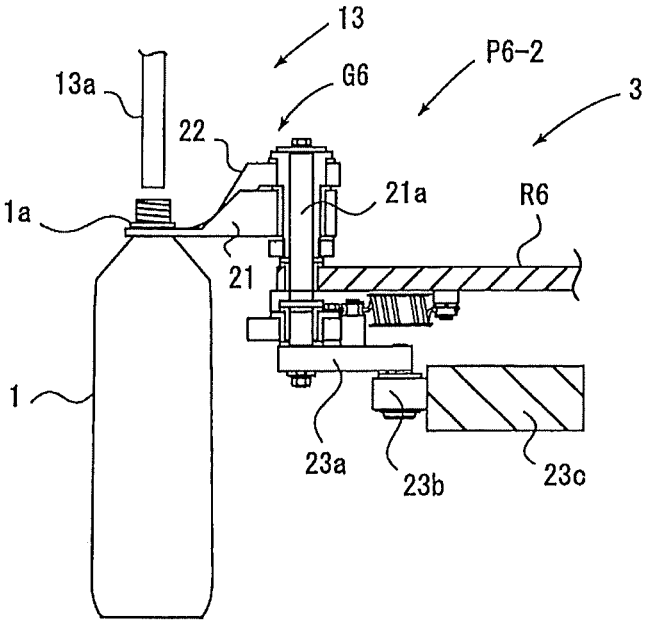
FIG. 3 is a sectional view illustrating a first filling position of the filling apparatus.

The container 1 according to the present embodiment is a PET bottle. As shown in FIG. 3, a neck formed in upper part of the container 1 is provided with a flange 1*a* such that the container 1 will be conveyed with upper part or lower part of the flange 1*a* being gripped by a gripper described later.

The container processing system 2 is controlled by a non-illustrated control unit and includes a filling apparatus 3 serving as a main processing apparatus adapted to fill the container 1 with a beverage, a washing apparatus 4 provided on an upstream side of the filling apparatus 3 and serving as a secondary processing apparatus adapted to wash the containers 1, and a sterilization apparatus 5 provided further on an upstream side of the washing apparatus 4 and serving as a secondary processing apparatus adapted to sterilize the container 1.

First to third transfer apparatuses 6 to 8 used to receive the containers 1 from processing apparatuses on an upstream side and transfer the containers 1 to processing apparatuses on a downstream side are provided, respectively, on an upstream side of the sterilization apparatus 5, between the sterilization apparatus 5 and washing apparatus 4, and between the washing apparatus 4 and filling apparatus 3.

The filling apparatus 3, washing apparatus 4, sterilization apparatus 5, and first to third transfer apparatuses 6 to 8 respectively include first to sixth rotating bodies R1 to R6 provided rotatably, of which the first rotating body R1 located on an upstream side is connected with a supply conveyor 9 adapted to supply containers 1 and the sixth rotating body R6 on the most downstream side is connected with a discharge conveyor 10 adapted to discharge the containers 1.

Transfer positions A to G (or receiving positions A to G) are provided next to the supply conveyor 9, first to sixth rotating bodies R1 to R6, and discharge conveyor 10, respectively, and the containers 1 are transferred between the transfer positions and the respective ones of these components.

To fill the container 1 aseptically with a beverage, the container processing system 2 according to the present embodiment sterilizes the container 1 using the sterilization apparatus 5. Also, the filling apparatus 3, washing apparatus 4, sterilization apparatus 5, and first to third transfer apparatuses 6 to 8 are housed in an aseptic chamber 11.

The aseptic chamber 11 is partitioned into plural compartments 11*a* to 11*d*, in each of which a non-illustrated opening is formed, such that the filling apparatus 3, washing apparatus 4, sterilization apparatus 5, and first transfer apparatus 6 will be housed in the respective compartments 11*a* to 11*d*.

The compartments 11*a* to 11*d* are provided with respective pressure control units 12 adapted to control internal pressure of the compartments 11*a* to 11*d*. The compartment 11*a* housing the filling apparatus 3 is set to the highest positive pressure, and then positive pressure is decreased gradually in the order: the compartment 11*b* housing the washing apparatus 4, compartment 11*c* housing the sterilization apparatus 5, and compartment 11*d* housing the first transfer apparatus 6.

The compartment 11*d* housing the first transfer apparatus 6 is coupled to a supply chamber 11*e* through which the supply conveyor 9 passes and the compartment 11*a* housing the filling apparatus 3 is coupled to a discharge chamber 11*f* through which the discharge conveyor 10 passes.

The filling apparatus 3 serving as the main processing apparatus will be described. The filling apparatus 3 has plural grippers G6 serving as first holding units on a perimeter, the sixth rotating body R6 serving as the main rotating body adapted to move the grippers G6 while intermittently stopping the grippers G6 at plural stop positions, first to third filling units 13 to 15 adapted to fill the containers 1 with a beverage by serving as a first processing unit adapted to process the containers 1 at appropriate stop positions, and a capping unit 16 adapted to cap the containers 1.

The sixth rotating body R6 is driven by a servomotor M serving as a driving unit controlled by a control unit. According to the present embodiment, the sixth rotating body R6 is rotated at 60-degree intervals while intermittently stopped.

Also, two sets of six grippers G6 are provided at 60-degree intervals on a perimeter of the sixth rotating body R6 and the different sets of grippers G6 are provided to grip containers 1 differing in neck diameter.

Thus, in processing containers 1, one set of grippers G6 grip the containers 1 while the other set of grippers G6 do not grip the containers 1.

Also, six stop positions P6-1 to P6-6 are set at 60-degree intervals on the perimeter of the sixth rotating body R6 (see FIG. 13) and a control unit controls the sixth rotating body R6 such that one set of grippers G6 will be moved while intermittently stopped at the stop positions P6-1 to P6-6.

Since two sets of grippers G6 are provided on the perimeter of the sixth rotating body R6 as described above, in making a type change to fill containers 1 having different neck diameters with a beverage, it is sufficient that by controlling the servomotor M, the control unit changes a rotational position of the sixth rotating body R6 and moves the corresponding other set of grippers G6 to the respective stop positions P6-1 to P6-6.

Note that when the grippers G6 are configured to be changed at the time of a type change, there is no need to control the rotational position of the sixth rotating body R6, and thus it is not strictly necessary to use the servomotor M as a driving unit.

Figure 2:
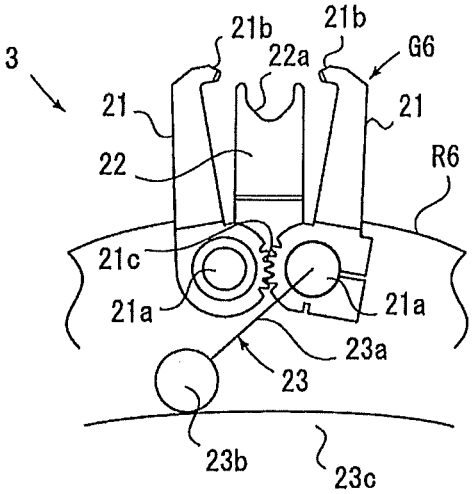
FIGS. 2(*a*) and 2(*b*) are plan views illustrating a gripper of a filling apparatus.
Figure 2:
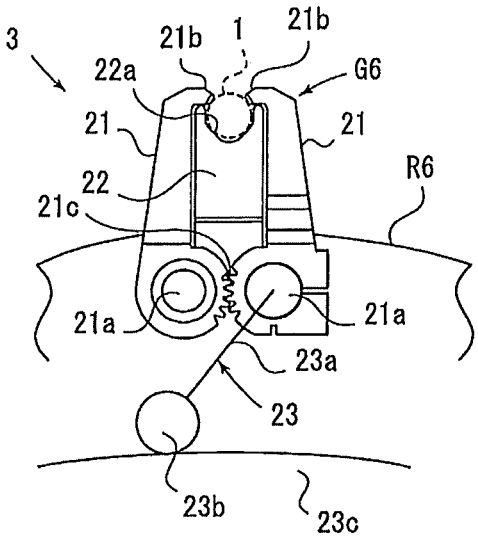

FIGS. 2(*a*) and 2(*b*) are plan views explaining opening and closing of the gripper G6 provided on the sixth rotating body R6, in which (a) shows an open state and (b) shows a closed state.

The gripper G6 includes a pair of gripping members 21 provided swingably on the sixth rotating body R6, a stopper 22 provided between the gripping members 21, and a swing mechanism 23 adapted to swing the gripping members 21.

Bases of the gripping members 21 are fixed to respective rotating shafts 21*a* rotatably provided on the sixth rotating body R6, and claws 21*b* adapted to get engaged with the neck of the container 1 is formed in tip portions of the respective gripping members 21.

The stopper 22 is fixed to the sixth rotating body R6 and an abutting portion 22*a* having a recessed shape and adapted to abut the neck of the container 1 is formed at a tip of the stopper 22.

With this configuration, when the gripping members 21 are closed, the claws 21*b* of the gripping members 21 and the abutting portion 22*a* of the stopper 22 hold the neck of the container 1 to keep the container 1 from falling off.

Although illustrated in a simplified form, the swing mechanism 23 includes gears 21*c* formed in the bases of the gripping members 21, an arm 23*a* coupled to the base of one of the gripping members 21, a cam follower 23*b* provided at a tip of the arm 23*a*, and a cam 23*c* fixed separately from the sixth rotating body R6.

When the cam follower 23*b* is moved in a radial direction of the sixth rotating body R6 by the cam 23*c*, the gripping member 21 coupled to the arm 23*a* swings accordingly and the other gripping member 21 swings via the gear 21*c* in conjunction, thereby opening or closing the gripping members 21.

FIG. 3 is a sectional view of the first filling unit 13 provided at a first filling position P6-2 serving as the stop position P6-2. The second and third filling units 14 and 15 at the second and third filling positions P6-3 and P6-4 have configurations similar to the first filling unit 13, and thus a detailed description thereof will be omitted.

A filling nozzle 13*a* is provided above the first filling position P6-2, being connected to a non-illustrated beverage supply unit.

According to the present embodiment, when the sixth rotating body R6 positions the gripper G6 holding the container 1 at the first filling position P6-2, the beverage is provided into the container 1 through the filling nozzle 13*a*.

Then, when filling with the beverage is finished, the sixth rotating body R6 moves the gripper G6 holding the container 1 to the second filling position P6-3 on the downstream side.

Here, the first to third filling units 13 to 15 are capable of providing different types of beverages. For example, the first filling unit 13 can be configured to provide a beverage containing solids using a cylinder-piston method, the second filling unit 14 can be configured to provide a non-carbonated beverage by non-gas filling using a flowmeter method, and the third filling unit 15 can be configured to provide a carbonated beverage by gas filling using a flowmeter method.

Therefore, for example, control can be performed such that with the first filling unit 13 filling containers 1 with a beverage at the first filling position P6-2, even if the containers 1 are positioned at the second or third filling position P6-3 or P6-4, the second and third filling units 14 and 15 are kept from operating by making the containers 1 wait. On the other hand, for example, control can be performed such that after the first filling unit 13 provides a predetermined amount of beverage containing solids into a container, the third filling unit 15 fills a remaining space of the container with a carbonated beverage, without using the second filling unit 14. In this way, various types of beverages can be provided.

Figure 4:
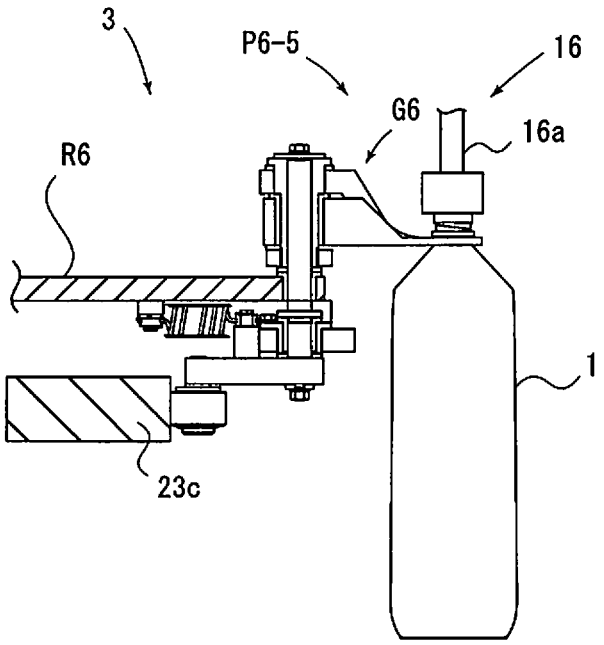
FIG. 4 is a sectional view illustrating a capping position of the filling apparatus.

The capping unit 16 shown in FIG. 4 is conventionally known, and thus a detailed description thereof will be omitted. The capping head 16*a* is moved up and down by a non-illustrated lifting unit provided above a capping position P6-5 serving as the stop position P6-5, and the capping head unit 16 is connected to a non-illustrated cap supply unit.

When the gripper G6 holding a container 1 is moved to the capping position P6-5 by the sixth rotating body R6 and stops there, the capping unit 16 performs the capping by moving the capping head 16*a* down.

When the capping is finished, the lifting unit separates the capping head 16*a* upward from the container 1, and then the sixth rotating body R6 moves the gripper G6 holding the container 1 to the transfer position G on the downstream side.

Figure 5:
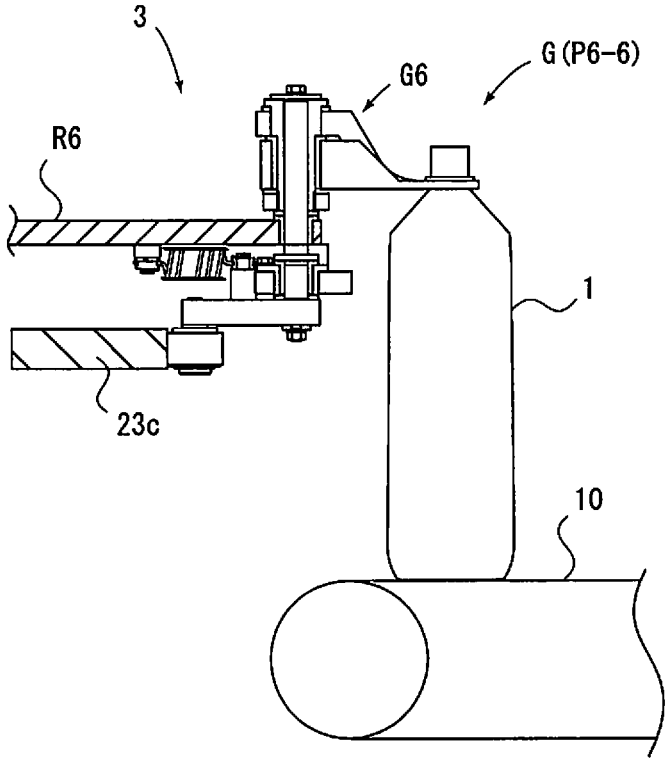
FIG. 5 is a sectional view illustrating a transfer position of the filling apparatus.

FIG. 5 is a sectional view of the transfer position G serving as the stop position P6-6 where the containers 1 are discharged onto the discharge conveyor 10 from the filling apparatus 3, in which the discharge conveyor 10 is provided in the transfer position G.

The sixth rotating body R6 has been designed to stop the gripper G6 at the transfer position G and a profile of the cam 23*c* has been set such that the gripper G6 will be opened at the transfer position G.

Also, the height of the discharge conveyor 10 is vertically adjustable according to a bottom height of the container 1 to be conveyed by the gripper G6 and when the gripper G6 stops at the transfer position G, the container 1 is placed on the discharge conveyor 10.

Then, when placed on the discharge conveyor 10, the container 1 is conveyed downstream by the discharge conveyor 10 and breaks away from the opened gripper G6.

Next, the sterilization apparatus 5 serving as a secondary processing apparatus will be described using FIGS. 6 to 8. The sterilization apparatus 5 includes the second rotating body R serving as a secondary rotating body having the gripper G2 serving as a second holding unit on a perimeter, a sterilization gas ejection unit 31 adapted to eject sterilization gas into the container 1 as a second processing unit, and a hot air ejection unit 32 adapted to eject hot air into the container 1.

Figure 13:
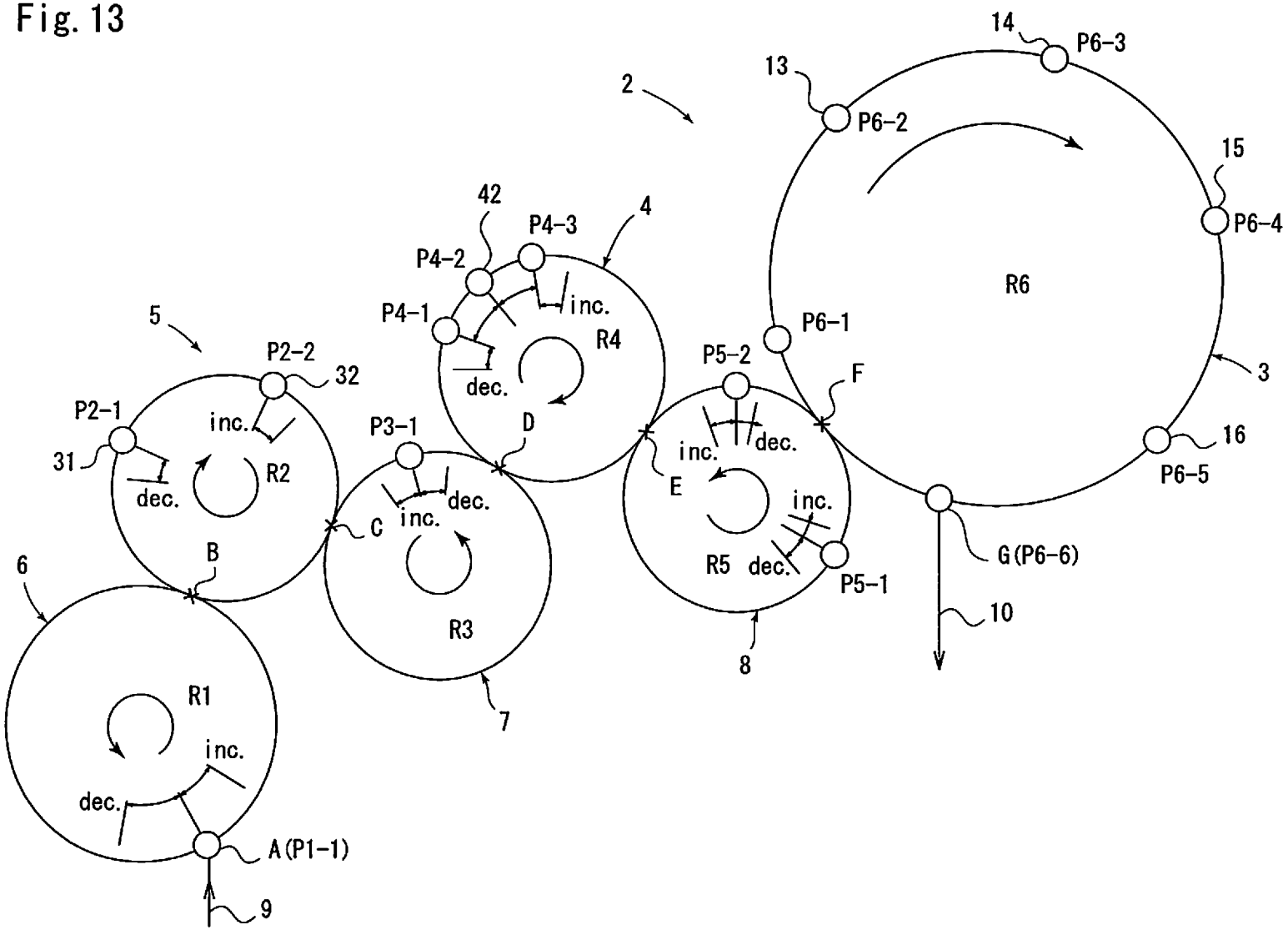
FIG. 13 is a diagram illustrating operation of a gripper in the container processing system.

The second rotating body R2, which is driven by the servomotor M controlled by the control unit, stops the gripper G2 at a sterilization gas ejection position P2-1 serving as a processing position as well as at a hot air ejection position P2-2 on the downstream side along a rotational direction of the second rotating body R2 (see FIG. 13).

Two grippers G2 are positioned 180 degrees opposite each other on the perimeter of the second rotating body R2, which grippers G2 are designed to grip containers 1 with different neck diameters.

Therefore, at the time of a type change, it is sufficient for the control unit to control the second rotating body R2 such that an appropriate one of the grippers G2 will be stopped at the sterilization gas ejection position P2-1 and the hot air ejection position P2-2.

Note that when the gripper G2 is changed at the time of a type change, it is sufficient that one gripper G2 is provided on the second rotating body R2.

The gripper G2 is conventionally known, and thus a detailed description thereof will be omitted. The gripper G2 is made up of a pair of gripping members biased by a biasing force of a spring in such a direction as to be normally closed.

At a receiving position B where the gripper G2 of the second rotating body R2 receives the container 1 from the adjacent first rotating body R1 on the upstream side, the gripper G1 of the first rotating body R1 thrusts the container 1 between the gripping members of the gripper G2 while still gripping the container 1.

Consequently, the gripping members open against the biasing force of the spring, and when the container 1 is gripped by the gripping members, the gripper G1 opens and transfers the container 1 to the gripper G2.

On the other hand, at the transfer position C where the container 1 is transferred from the gripper G2 of the second rotating body R2 to the adjacent third rotating body R3 on the downstream side, the gripper G3 of the third rotating body R3 grips the container 1, with the gripper G2 gripping the container 1.

Subsequently, when the gripper G3 pulls out the container 1 while separating from the gripper G2 in keeping with rotation of the third rotating body R3, the gripping members open against the biasing force of the spring, allowing the container 1 to break away from the gripper G2.

Figure 6:
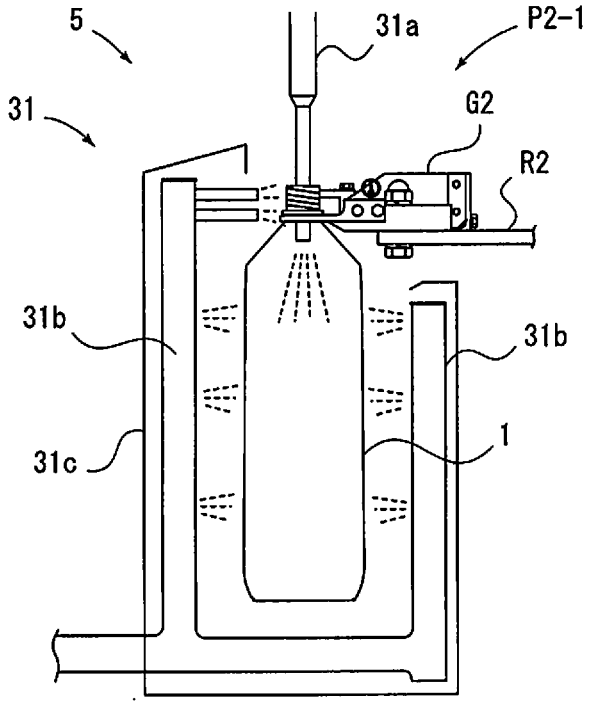
FIG. 6 is a sectional view illustrating a sterilization gas ejection position of a sterilization apparatus.
Figure 7:
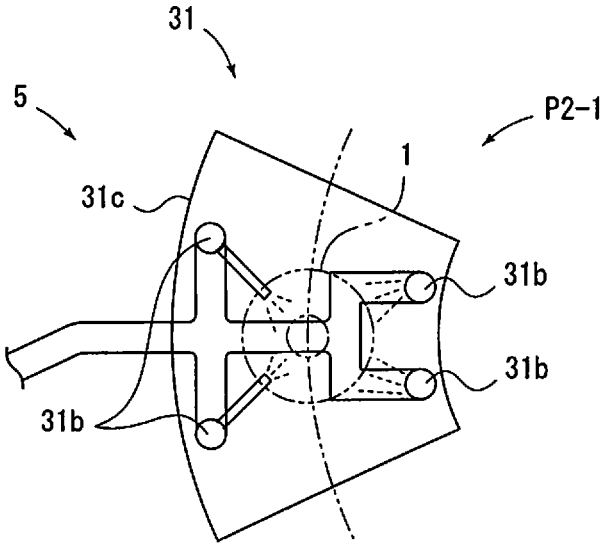
FIG. 7 is a plan view illustrating the sterilization gas ejection position of the sterilization apparatus.

FIG. 6 is a sectional view of the sterilization gas ejection unit 31 serving as the second processing unit and FIG. 7 is a plan view, in which the sterilization gas ejection unit 31 includes an inner-use nozzle 31*a* provided above the sterilization gas ejection position P2-1 and adapted to eject sterilization gas into the container 1, and an outer-use nozzle 31*b* adapted to eject sterilization gas outside the container 1, and a housing 31*c* for use to prevent scattering of the sterilization gas.

The inner-use nozzle 31*a* is moved up and down by a non-illustrated lifting unit and connected to a non-illustrated sterilization gas supply unit. When the gripper G2 stops the container 1 at the sterilization gas ejection position P2-1, the lifting unit moves down the inner-use nozzle 31*a* and inserts a tip of the inner-use nozzle 31*a* into the container 1 such that the sterilization gas will be ejected in this state.

When the ejection of the sterilization gas is finished, the lifting unit moves up the inner-use nozzle 31*a*, causing the inner-use nozzle 31*a* to break away from the container 1 and then the second rotating body R2 moves the gripper G2 to the hot air ejection position P2-2 next.

The outer-use nozzle 31*b* is connected to a non-illustrated sterilization gas supply unit, and a tip of the outer-use nozzle 31*b* is divided into multiple branches in such a way as to surround the container 1 stopped at the sterilization gas ejection position P2-1. Then, by ejecting the sterilization gas through ejection holes formed in tip portions, the sterilization gas is ejected to an entire outer surface of the container 1.

The housing 31*c* is formed covering a neighborhood of the sterilization gas ejection position P2-1 and a space is formed along a movement route of the container 1 in such a way as to minimize scattering of the sterilization gas ejected from the outer-use nozzle 31*b*.

Figure 8:
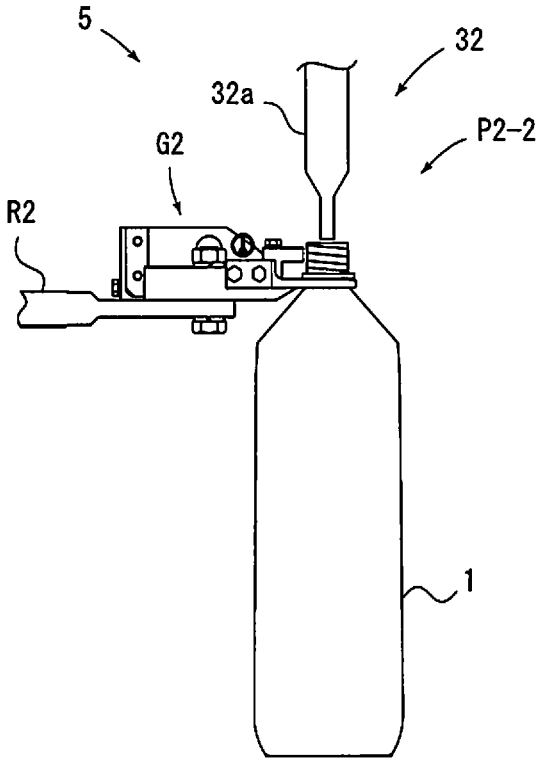
FIG. 8 is a sectional view illustrating a hot air ejection position of the sterilization apparatus.

FIG. 8 is a sectional view of the hot air ejection unit 32 serving as a second processing unit. The hot air ejection unit 32 includes a hot air nozzle 32*a* provided above the hot air ejection position P2-2, adapted to eject hot air into the container 1, and connected to a non-illustrated hot air supply unit.

When the gripper G2 driven by the second rotating body R2 moves the container 1 to the hot air ejection position P2-2 and stops the container 1, a mouth of the container 1 is brought close to a tip of the hot air nozzle 32*a*, which then ejects hot air, activating the sterilization gas ejected into the container 1.

When the ejection of the hot air is finished, the second rotating body R2 moves the gripper G2.

Here, in using hot gas to activate the sterilization gas ejected into the container 1, the time after the ejection of the sterilization gas into the container 1 until the ejection of the hot air is desirably minimized.

Thus, when the sterilization gas is ejected into the container 1 at the sterilization gas ejection position P2-1, the control unit ensures that the second rotating body R2 moves the gripper G2 immediately to the hot air ejection position P2-2, followed by hot air ejection of the hot air ejection unit 32.

Next, the washing apparatus 4 serving as a secondary processing apparatus will be described using FIGS. 9 to 11. The washing apparatus 4 includes the fourth rotating body R4 serving as a secondary rotating body having a gripper G4 serving as a second holding unit on a perimeter, a reversal mechanism 41 adapted to reverse the gripper G4 together with the container 1, and a washing unit 42 serving as a second processing unit adapted to eject a cleaning solution into the container 1.

The fourth rotating body R4, which is driven by the servomotor M controlled by the control unit, stops at processing positions including a reversal position P4-1 where the container 1 gripped by the gripper G4 is turned from an upright state to an inverted state with the neck down, a washing position P4-2 where the washing unit 42 washes the container 1, and a return position P4-3 where the container 1 in an inverted state is returned to an upright state (see FIG. 13).

One gripper G4 is provided on the perimeter of the fourth rotating body R4, whose gripping members described later are changed according to the neck diameter at the time of a type change. Note that as with the second rotating body R2 of the sterilization apparatus 5 the fourth rotating body R4 may be provided with two grippers G4 corresponding to different neck diameters.

Figure 9:
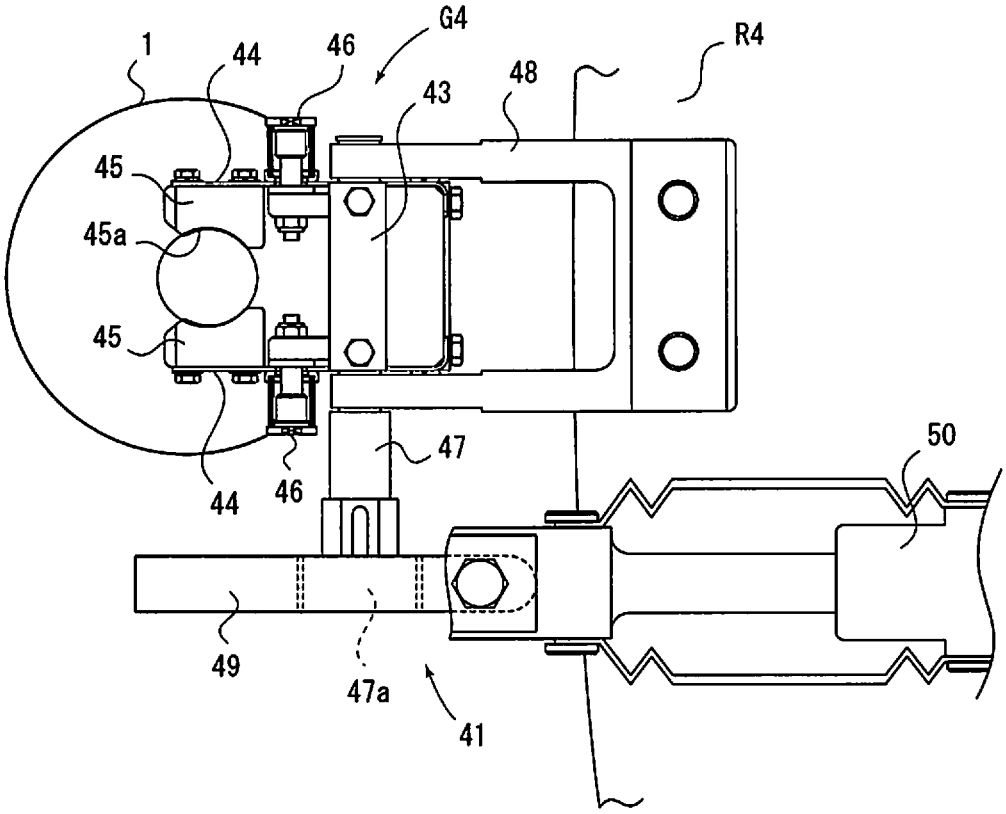
FIG. 9 is a plan view illustrating a gripper of a washing apparatus.

As shown in FIG. 9, the gripper G4 of the fourth rotating body R4 includes a bracket 43 provided in such a way as to be able to be turned by the reversal mechanism 41, a pair of plate members 44 provided at opposite ends of the bracket 43, a pair of gripping members 45 provided at tips of the plate members 44 and adapted to grip the neck of the container 1, and a pair of springs 46 adapted to bias the plate members 44 in a closing direction.

Arc-shaped abutting portions 45*a* are formed on the respective gripping members 45 to suit the neck diameter of the container 1 such that at the time of a type change, a change will be made to gripping members 45 on which abutting portions 45*a* corresponding to the neck diameter are formed.

At a receiving position D where the gripper G4 of the fourth rotating body R4 receives the container 1 from the adjacent third rotating body R3 on the upstream side, the gripper G3 of the third rotating body R3 thrusts the container 1 between the gripping members 45 of the gripper G4 while still gripping the container 1.

Consequently, the gripping members 45 open against biasing forces of the springs 46, allowing the container 1 to be fitted into and held by the abutting portions 45*a* of the gripping members 45, and then the gripper G3 opens to transfer the container 1 to the gripper G4.

On the other hand, at the transfer position E where the container 1 is transferred from the gripper G4 of the fourth rotating body R4 to the adjacent fifth rotating body R5 on the downstream side, the gripper G5 of the fifth rotating body R5 grips the container 1, with the gripper G4 gripping the container 1.

Subsequently, when the gripper G5 pulls out the container 1 while separating from the gripper G4 in keeping with rotation of the fifth rotating body R5, the gripping members 45 open against biasing forces of the springs 46, allowing the container 1 to break away from the gripper G4.

The reversal mechanism 41 includes a rotating shaft 47 fixed to the bracket 43 of the gripper G4, a shaft support 48 substantially U-shaped in plane view, fixed to the fourth rotating body R4, and adapted to rotatably support the rotating shaft 47; a pinion 47*a* provided at a tip of the rotating shaft 47; a rack 49 meshed with the pinion 47*a*; and an air cylinder 50 serving as a driving unit adapted to advance and retract the rack 49.

The rotating shaft 47 is provided horizontally, facing a tangential direction of the fourth rotating body R4. Consequently, when the rotating shaft 47 is turned 180 degrees, the bracket 43 rotates, reversing the container 1 together with the gripping members 45 such that the neck will face downward.

Figure 10:
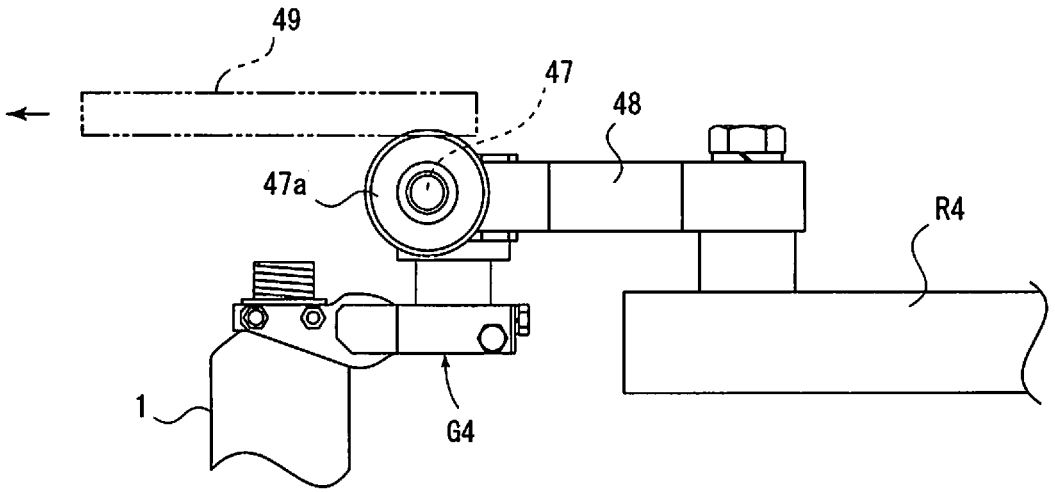
FIG. 10 is a sectional view illustrating the gripper of the washing apparatus, the gripper being in an upright state.
Figure 11:
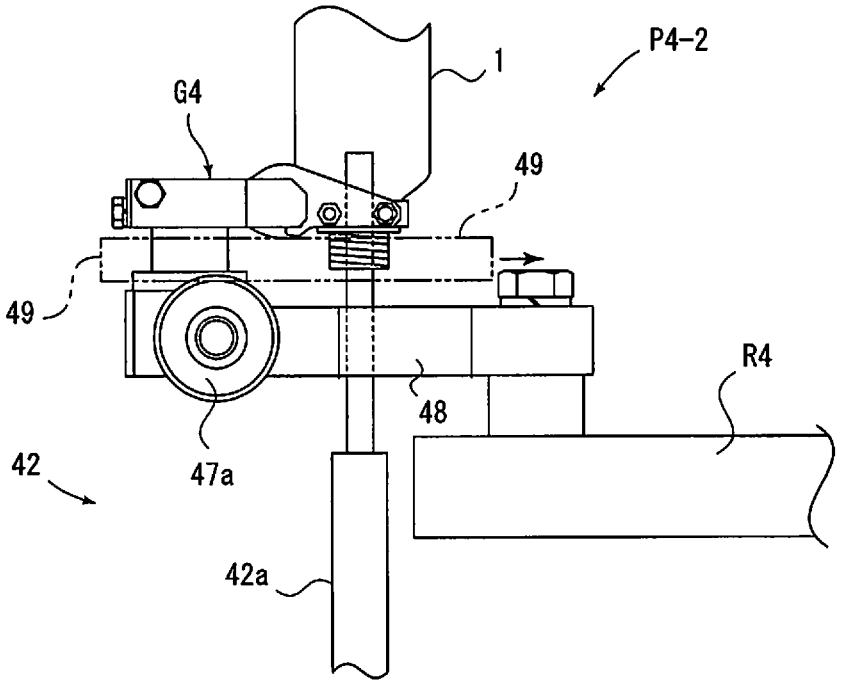
FIG. 11 is a sectional view illustrating a washing position of the washing apparatus.

With the air cylinder 50 having been designed to advance and retract the rack 49 in a radial direction of the fourth rotating body R4, when the rack 49 is moved toward an inner periphery of the fourth rotating body R4, the pinion 47*a* rotates reversing the container 1 from an upright state shown in FIG. 10 to an inverted state shown in FIG. 11, and conversely when the rack 49 is moved toward an outer periphery, the container 1 is returned to the upright state from the inverted state.

Note that the driving unit adapted to drive the rack 49 is not limited to the air cylinder 50 described above, and may be made up of a cam follower coupled to the rack 49 and a cam adapted to advance and retract the cam follower in the radial direction of the fourth rotating body R4. Alternatively, it is conceivable to rotate the rotating shaft 47 directly using a motor.

FIG. 11 is a sectional view of the washing unit 42 serving as the second processing unit. The washing unit 42 includes a cleaning solution nozzle 42*a* provided under the washing position P4-2 and adapted to eject a cleaning solution into the container 1. The cleaning solution nozzle 42*a* is moved up and down by a non-illustrated lifting unit and is connected to a non-illustrated cleaning solution supply unit.

When the gripper G4 moves the inverted container 1 to the washing position P4-2 and stops the container 1, the lifting unit moves up the cleaning solution nozzle 42*a*, and inserts a tip of the cleaning solution nozzle 42*a* into the container 1. In this state, when the cleaning solution is ejected from the cleaning solution nozzle 42*a*, the ejected cleaning solution washes an inner surface of the container 1 and drops down through the mouth of the container 1.

When the ejection of the cleaning solution is finished, the lifting unit moves the cleaning solution nozzle 42*a* down and makes the cleaning solution nozzle 42*a* break away from the container 1, and then the fourth rotating body R4 moves the gripper G4 to the next return position P4-3, stops the gripper G4 there, and returns the container 1 to the upright state from the inverted state.

Figure 12:
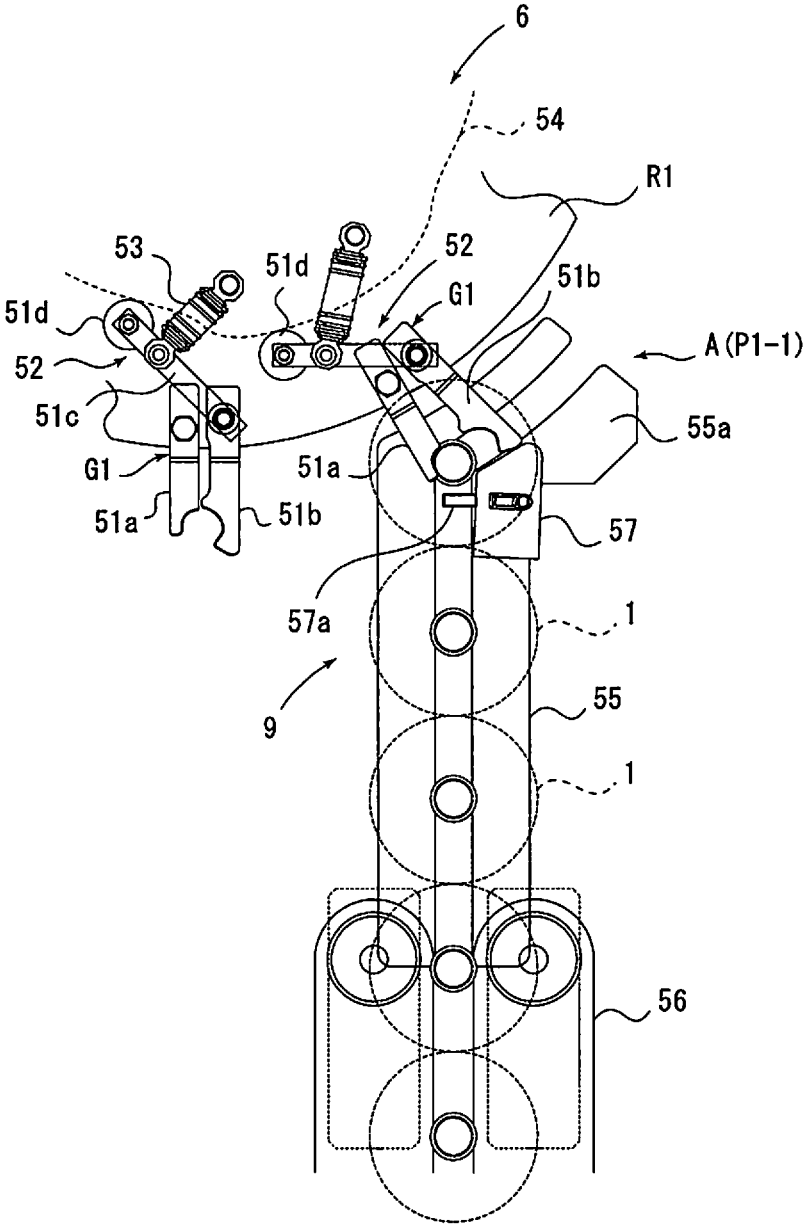
FIG. 12 is a plan view illustrating a first transfer apparatus and a supply conveyor.

Next, configurations of the first to third transfer apparatuses 6 to 8 will be described using FIG. 12. The configurations of the first to third transfer apparatuses 6 to 8 are identical, and thus the first transfer apparatus 6 will be described and a description of the second and third transfer apparatuses 7 and 8 will be omitted.

The first transfer apparatus 6 includes the first rotating body R1 serving as a transfer rotating body having the gripper G1 serving as a third holding unit on a perimeter. According to the present embodiment, to accommodate containers 1 with different neck diameters, two grippers G1 differing in gripping diameter are provided in opposite positions of the first rotating body R1.

The first rotating body R1, which is driven by the servomotor M controlled by the control unit, stops the container 1 gripped by the gripper G1 at the receiving position A serving as a waiting position P1-1 (see FIG. 13) connected with the supply conveyor 9.

The gripper G1 includes two gripping members 51*a* and 51*b* and a swing mechanism 52 adapted to swing the gripping member 51*b* of the gripping members.

One gripping member 51*a* of the gripping members is fixed to the first rotating body R1 and an arc-shaped abutting portion is formed in a tip portion of the fixed gripping member 51*a* to suit the neck of the container 1.

The other gripping member 51*b* is provided swingably on the first rotating body R1 at a position immediately downstream of the gripping member 51*a* in a rotational direction of the first rotating body R1, and the arc-shaped abutting portion is formed in the tip portion of the fixed gripping member 51*a*.

With this configuration, when the swingable gripping member 51*b* is closed by the swing mechanism 52, the container 1 can be gripped by surrounding half or more of a perimeter of the neck of the container 1 with the abutting portion of the fixed gripping member 51*a* and the abutting portion of the swingable gripping member 51*b*.

The swing mechanism 52, which swings the swingable gripping member 51*b* in such a way as to open a tip portion of the swingable gripping member 51*b* to the downstream side in the rotational direction, includes an arm 51*c* coupled to a base of the swingable gripping member 51*b*, a spring 53 elastically installed between the arm 51*c* and the first rotating body R1, a cam follower 51*d* provided at a tip of the arm 51*c*, and a cam 54 adapted to move the cam follower 51*d* in a radial direction of the first rotating body R1.

With the above configuration, the spring 53 biases the arm 51*c* such that the swingable gripping member 51*b* will maintain a closed state near the fixed gripping member 51*a*, while on the other hand, when the cam follower 51*d* is moved outward by the cam 54, the arm 51*c* swings against a biasing force of the spring 53, opening the swingable gripping member 51*b*, and thereby opening up the first gripper G1.

The supply conveyor 9 that supplies the containers 1 to the first rotating body R1 will now be described. The supply conveyor 9 includes rails 55 adapted to convey the container 1 by supporting the flange 1*a*, a container supply unit 56 provided on an upstream side of the rails 55, and a stopper 57 provided on the rails 55 and adapted to stop the container 1.

The rails 55 are set to width of the neck of the container 1 and convey the container 1 by sliding the container 1 while supporting the flange 1*a* from below. Then, the container supply unit 56 supplies the containers 1 to the first rotating body R1, leaving no space, and conveys the containers 1 in such a way that the container 1 on the upstream side will press the container 1 on the downstream side.

Also, those parts of the rails 55 which are adjacent to the first rotating body R1 are bent in the rotational direction of the first rotating body R1, and bent portions 55*a* are formed along the movement route of the containers 1 moved by the gripper G1 of the first rotating body R1.

The receiving position A where the gripper G1 of the first rotating body R1 according to the present embodiment receives the containers 1 from the supply conveyor 9 is set at bases of the bent portions 55*a* of the rails 55 and the first rotating body R1 stops the gripper G1 at the receiving position A.

Furthermore, the cam 54 is configured such that the gripper G1 will open at the receiving position A and such that the gripper G1 will be closed by moving downstream from the receiving position A.

Therefore, until the gripper G1 moves and gets closed, the container 1 is supported by the bent portions 55*a* of the rails 55 in such a way as not to fall off.

The stopper 57 includes a pin 57*a* pushed out and pulled in by the control unit, which stops the container 1 at a position separated upstream of the bases of the bent portions 55*a* of the rails 55 by pushing out the pin 57*a*.

After the gripper G1 of the first rotating body R1 receives the container 1 at the receiving position A, when the gripper G1 comes to the receiving position A again, the pin 57*a* is pulled in allowing one container 1 to pass, and then pushed out again to stop the container 1.

With this configuration, when the stopper 57 pushes out and pulls in the pin 57*a*, the supply conveyor 9 supplies containers 1 one by one to the gripper G1 stopped at the receiving position A in an open state.

Then, the container 1 enters between the two gripping members 51*a* and 51*b* of the gripper G1, and subsequently the control unit rotates the first rotating body R1, thereby starting to move the gripper G1. Consequently, the swingable gripping member 51*b* is caused by the cam 54 to swing gradually in a closing direction, eventually entering a closed state, and thus the container 1 is received by the gripper G1.

Subsequently, at a transfer position B where the gripper G1 transfers the container 1 to the second rotating body R2 immediately downstream of the first rotating body R1, while still gripping the container 1, the gripper G1 forcibly opens the gripper G2 of the second rotating body R2 and makes the gripper G2 grip the container 1.

Subsequently, while separating from the second rotating body R2 in keeping with rotation of the first rotating body R1, the gripper G1 is put into an open state from a closed state by the cam 54, getting ready to transfer the container 1 to the second rotating body R2.

As a transfer rotating body making up a second transfer apparatus 7, the third rotating body R3 includes the gripper G3 serving as a third holding unit with a configuration similar to that of the gripper G1 of the first rotating body R1, and similarly, as a transfer rotating body making up a third transfer apparatus 8, the fifth rotating body R5 includes the gripper G5 serving as a third holding unit with a configuration similar to that of the gripper G1. Note that a description of the operation of transferring containers 1 from the grippers G3 and G5 to adjacent rotating bodies will be omitted.

As shown in FIG. 13, a waiting position P3-1 where the third rotating body R3 making up the second transfer apparatus 7 stops the gripper G3, the gripper G3 is caused to wait between a transfer position D for transfer to the fourth rotating body R4 and a receiving position C for reception from the second rotating body R2 on the third rotating body R3.

In contrast, the fifth rotating body R5 making up the third transfer apparatus 8 stops the gripper G5 at two waiting positions P5-1 and P5-2, causing the gripper G5 to wait, and the waiting positions P5-1 and P5-2 are established in respective sections between a transfer position F on the fifth rotating body R5 for transfer to the sixth rotating body R6 and a receiving position E on the fifth rotating body R5 for reception from the fourth rotating body R4.

Operation of the container processing system 2 with the above configuration will be described below. FIG. 13 is a diagram explaining movements of the grippers G1 to G6 of the first to sixth rotating bodies R1 to R6 making up the filling apparatus 3, the sterilization apparatus 5, the washing apparatus 4, and the first to third transfer apparatuses 6 to 8, and stop positions, processing positions, and waiting positions where the grippers G1 to G6 stop are indicated by circles.

First, an operator prepares the containers 1 to be used and a beverage to be provided and sets information thereon on the control unit. Here, settings are made regarding the neck diameter and height of the containers 1 to be used and regarding which of the first to third filling units 13 to 15 of the filling apparatus 3 to use in filling the containers 1 with the beverage.

According to the above settings, the control unit controls the rotational positions of the first to third, fifth, and sixth rotating bodies R1 to R3, R5, and R6 and places the grippers G1 to G3, G5, and G6 most suitable for the neck diameter of the containers 1 to be processed at the stop positions, processing positions, or waiting positions. Also, the operator changes the gripper G4 of the fourth rotating body R4 in advance according to the neck diameter of the containers 1.

Furthermore, the control unit sets the height of the discharge conveyor 10 adjacent to the sixth rotating body R6 of the filling apparatus 3. Note that the height of the discharge conveyor 10 may be set manually by the operator.

Then, when the operator gives a start filling command via the control unit, the container processing system 2 starts filling the containers 1 with the beverage as follows.

First, operation of the filling apparatus 3 serving as the main processing apparatus will be described. The sixth rotating body R6 serving as the main rotating body moves the grippers G6 while intermittently stopping the grippers G6 at fixed intervals, and at the first to third filling positions P6-2 to P6-4, an appropriate one of the first to third filling units 13 to 15 comes into operation as a first processing unit and provides a beverage. Subsequently, at the capping position P6-5, the capping unit 16 serving as a first processing unit caps the container 1, and the container 1 is discharged by the discharge conveyor 10 at the transfer position G (P6-6).

Also, a stop position immediately on the upstream side of the first filling position P6-2 is set to be a waiting position P6-1 where no processing is performed, and a receiving position F where the containers 1 are received from the fifth rotating body R5 of the third transfer apparatus 8 is established between the transfer position G (P6-6) and waiting position P6-1.

In this way, on the filling apparatus 3, the sixth rotating body R6 moves each gripper G6 while intermittently stopping the gripper G6 at stop positions P6-1 to P6-6 in this order, i.e., for example, the gripper G6 is stopped at each stop position for 9 seconds and then moves the gripper G6 to the next stop position in the downstream direction in 3 seconds and stops the gripper G6 there.

That is, 12 seconds are required for one intermittent motion taking place during the time interval from when the sixth rotating body R6 serving as the main rotating body stops the gripper G6 at an appropriate stop position to when the sixth rotating body R6 moves and stops the gripper G6 at the next stop position.

The time required for one intermittent motion is determined based on the longest of processing times taken by the first to third filling units 13 to 15 and capping unit 16. For example, even if only 4 seconds are required for the second filling unit 14 to fill the container 1 with the beverage at the second filling position P6-3, it is necessary to make the gripper G6 wait for 9 seconds.

The sterilization apparatus 5 and washing apparatus 4 serving as a secondary processing apparatus as well as the first to third transfer apparatuses 6 to 8 operate in synchronization with one intermittent motion of the filling apparatus 3 serving as the main processing apparatus.

Specifically, in 12 seconds required for one intermittent motion, each of the first to fifth rotating bodies R1 to R5 serving as a secondary rotating body or transfer rotating body is rotated once, and during this time, the container 1 is processed and transferred from an upstream rotating body to a downstream rotating body.

Note that "operating in synchronization with one intermittent motion" here does not require controlling operations of the sterilization apparatus 5 and washing apparatus 4 and first to third transfer apparatuses 6 to 8, timed with the start and end of one intermittent motion of the filling apparatus 3 serving as the main processing apparatus, the sterilization apparatus 5 and washing apparatus 4 serving as a secondary processing apparatus.

That is, operation may be started in the middle of one intermittent motion of the filling apparatus 3, and it is sufficient that the secondary rotating body making up the sterilization apparatus 5 and washing apparatus 4 and the transfer rotating body making up the first to third transfer apparatuses 6 to 8 rotate once with whatever timing in 12 seconds required for one intermittent motion of the filling apparatus 3.

First, on the first transfer apparatus 6, the supply conveyor 9 supplies empty containers 1 one by one to the first rotating body R1, which has been making the gripper G1 wait at the receiving position A (waiting position P1-1) connected with the supply conveyor 9.

At the receiving position A, the gripper G1 is in an open state, and when a new container 1 is supplied to the gripper G1, the control unit moves the first rotating body R1 of the first transfer apparatus 6.

The gripper G1 starts movements using the receiving position A as a starting point, then transfers the container 1 to the second rotating body R2 of the sterilization apparatus 5 by passing through the transfer position B for transfer to the second rotating body R2 of the sterilization apparatus 5, and stops at the receiving position A after making one turn.

In so doing, the time between when the gripper G1 starts moving from the receiving position A and when the gripper G1 stops at the receiving position A again and starts moving again is set equal to the time taken for one intermittent motion of the filling apparatus 3.

While the first rotating body R1 rotates the gripper G1 once, by changing the rotational velocity of the first rotating body R1 according to the position of the gripper G1, the control unit can change the moving velocity of the gripper G1.

Specifically, by designating a section extending downstream of the receiving position A in the rotational direction of the first rotating body R1 as an acceleration section, and a section extending upstream of the receiving position A in the rotational direction as a deceleration section, a section between the acceleration section and deceleration section is established as a constant velocity section in which the gripper G1 moves at constant velocity.

The transfer position B for transfer to the second rotating body R2 has been established as the constant velocity section, and to transfer the container 1 at the transfer position B, the moving velocity of the gripper G1 moved by the first rotating body R1 and the moving velocity of the gripper G2 moved by the second rotating body R2 are set equal to each other.

Therefore, the control unit starts moving the gripper G1 at the waiting position P1-1 (the receiving position A) and controls waiting time at the waiting position P1-1 as well as acceleration in the acceleration section and deceleration section such that passage of the gripper G1 through the transfer position B will coincide in timing with passage of the gripper G2 of the second rotating body R2 through the receiving position B.

Next, the sterilization apparatus 5 rotates the second rotating body R2 once during the above-mentioned one intermittent motion of the filling apparatus 3 and according to the present embodiment, the hot air ejection position P2-2 is set as a waiting position of the gripper G2.

Consequently, the gripper G2 starts moving using the hot air ejection position P2-2 as a starting point, subsequently transfers the container 1 by passing through the transfer position C for transfer to the third rotating body R3 of the second transfer apparatus 7, then receives a container 1 by passing through the receiving position B for reception from the first rotating body R1 of the first transfer apparatus 6, stops at the sterilization gas ejection position P2-1 in order for the sterilization gas ejection unit 31 to perform processing, and then makes a turn and stops at the hot air ejection position P2-2 again in order for the hot air ejection unit 32 to perform processing.

Again, while the second rotating body R2 rotates the gripper G2 once, by changing the moving velocity according to the position of the gripper G2, the control unit establishes a deceleration section on the upstream side of the sterilization gas ejection position P2-1 in the rotational direction, an acceleration section on the downstream side of the hot air ejection position P2-2 in the rotational direction, and a constant velocity section between the deceleration section and acceleration section.

The receiving position B for reception from the first rotating body R1 and the transfer position C for transfer to the third rotating body R3 are located in the constant velocity section, and to transfer the containers 1, the moving velocity of the gripper G2 moved by the second rotating body R2 is set equal to the moving velocity of the gripper G1 moved by the first rotating body R1 and the moving velocity of the gripper G3 moved by the third rotating body R3.

On the other hand, the moving velocity of the gripper G2 between the sterilization gas ejection position P2-1 and the hot air ejection position P2-2 can be set to the optimal moving velocity for using hot gas to activate the sterilization gas ejected into the container 1 as described above.

As described above, during one intermittent motion of the filling apparatus 3, the sterilization apparatus 5 performs processes by stopping the gripper G2 at the sterilization gas ejection position P2-1 and the hot air ejection position P2-2 via the second rotating body R2.

That is, the processing times taken by the sterilization gas ejection unit 31 and the hot air ejection unit 32 of the sterilization apparatus 5 can be varied from the processing time of the processing units making up the filling apparatus 3, and in particular, the sterilization apparatus 5 allows multiple processes to be performed at multiple processing positions during one intermittent motion.

Next, the second transfer apparatus 7 rotates the third rotating body R3 once during the above-mentioned one intermittent motion of the filling apparatus 3, and according to the present embodiment, the waiting position P3-1 of the gripper G3 is set between the transfer position D for transfer to the fourth rotating body R4 of the washing apparatus 4 and the receiving position C for reception from the second rotating body R2 of the sterilization apparatus 5.

Consequently, the gripper G3 starts moving using the waiting position P3-1 as a starting point, first receives the container 1 by passing through the receiving position C for reception from the second rotating body R2 of the sterilization apparatus 5, then transfers the container 1 by passing through the transfer position D for transfer to the fourth rotating body R4 of the washing apparatus 4 and subsequently makes a turn and stops at the waiting position P3-1 again.

Again, while the third rotating body R3 rotates the gripper G3 once, by changing the moving velocity according to the position of the gripper G3, the control unit establishes a deceleration section on the upstream side of the waiting position P3-1 in the rotational direction, an acceleration section on the downstream side in the rotational direction, and a constant velocity section between the deceleration section and acceleration section.

Since the receiving position C for reception from the second rotating body R2 and transfer position D for transfer to the fourth rotating body R4 are located in the constant velocity section, the moving velocity of the gripper G3 moved by the third rotating body R3 is set equal to the moving velocity of the gripper G2 moved by the second rotating body R2 and the moving velocity of the gripper G4 moved by the fourth rotating body R4.

Next, the washing apparatus 4 rotates the fourth rotating body R4 once during the above-mentioned one intermittent motion of the filling apparatus 3, and according to the present embodiment, the washing position P4-2 has been set as a waiting position of the gripper G4.

Consequently, the gripper G4 starts moving using the washing position P4-2 as a starting point, subsequently stops at the return position P4-3 and returns the container 1 to the upright state from the inverted state, transfers the container 1 by passing through the transfer position E for transfer to the fifth rotating body R5 of the third transfer apparatus 8, then receives the container 1 by passing through the receiving position D for reception from the third rotating body R3 of the second transfer apparatus 7, stops at the reversal position P4-1 and inverts the container 1, and makes a turn and stops at the washing position P4-2 again in order for the washing unit 42 to perform processing.

Again, while the fourth rotating body R4 rotates the gripper G4 once, by changing the moving velocity according to the position of the gripper G4, the control unit establishes a deceleration section on the upstream side of the reversal position P4-1 in the rotational direction, an acceleration section on the downstream side of the return position P4-3 in the rotational direction, and a constant velocity section between the deceleration section and the acceleration section.

Since the receiving position D for reception from the third rotating body R3 and the transfer position E for transfer to the fifth rotating body R5 are located in the constant velocity section, the moving velocity of the gripper G4 moved by the fourth rotating body R4 is set equal to the moving velocity of the gripper G3 moved by the third rotating body R3 and the moving velocity of the gripper G5 moved by the fifth rotating body R5.

On the other hand, in the section from the reversal position P4-1 to the return position P4-3, the gripper G4 can be moved at any moving velocity, and the moving velocity can be set as desired according to the waiting time at the washing position P4-2.

Thus, again, while the sixth rotating body R6 performs one intermittent motion on the filling apparatus 3, the washing apparatus 4 can perform respective processes at the reversal position P4-1, washing position P4-2, and return position P4-3 at which the fourth rotating body R4 stops the gripper G4. That is, multiple processes can be performed at multiple processing positions during one intermittent motion of the filling apparatus 3.

Note that although in the present embodiment, the washing apparatus 4 performs the operations of inverting and returning the container 1 by stopping the gripper G4 at the reversal position P4-1 and the return position P4-3, the reversal mechanism 41 may be operated while moving the gripper G4 without stopping. In that case, the washing apparatus 4 will have one processing position: the washing position P4-2.

Besides, the third transfer apparatus 8 rotates the fifth rotating body R5 once during the above-mentioned one intermittent motion of the filling apparatus 3, and according to the present embodiment, the gripper G5 is caused to wait at a first waiting position P5-1 established on the downstream side of the receiving position E for reception from the fourth rotating body R4 of the washing apparatus 4 and at a second waiting position P5-2 established on the downstream side of the transfer position F for transfer to the sixth rotating body R6 of the filling apparatus 3.

The gripper G5 starts moving using the first waiting position P5-1 as a starting point, first transfers the container 1 by passing through the transfer position F for transfer to the sixth rotating body R6 of the filling apparatus 3, then stops at the second waiting position P5-2 and waits for a predetermined time, receives the container 1 by passing through the receiving position E for reception from the fourth rotating body R4 of the washing apparatus 4, and subsequently makes a turn and stops at the first waiting position P5-1 again.

Again, while the fifth rotating body R5 rotates the gripper G5 once, by changing the moving velocity according to the position of the gripper G5, the control unit establishes a deceleration section on the upstream side of the first waiting position P5-1 and second waiting position P5-2 in the rotational direction, an acceleration section on the downstream side in the rotational direction, and a constant velocity section between the deceleration section and the acceleration section.

Of these sections, in the constant velocity section in which the receiving position E for reception from the fourth rotating body R4 is established, the moving velocity of the gripper G5 is synchronized with the moving velocity of the gripper G4 moved by the fourth rotating body R4 at the receiving position E.

On the other hand, in the constant velocity section in which the transfer position F for transfer to the sixth rotating body R6 is established, the moving velocity of the fifth gripper G5 is synchronized with the moving velocity of the gripper G6 moved by the sixth rotating body R6 at the transfer position F.

Thus, since the first and second waiting positions P5-1 and P5-2 are established, the fifth rotating body R5 of the third transfer apparatus 8 varies the moving velocity of the gripper G5 in the constant velocity section established between the waiting positions P5-1 and P5-2 in such a way as to match the moving velocity of the gripper of the adjacent rotating body in each constant velocity section.

In this way, when the gripper G6 of the sixth rotating body R6 of the filling apparatus 3 receives a container 1 from the fifth rotating body R5 of the third transfer apparatus 8, on the filling apparatus 3, the sixth rotating body R6 moves the gripper G6 while intermittently stopping the gripper G6 at predetermined time intervals as described above such that the first to third filling units 13 to 15 fill the container 1 with beverages, and the capping unit 16 caps the container 1.

Subsequently, when the gripper G6 moves to and stops at the transfer position G (P6-6) where the discharge conveyor 10 is located, the gripper G6 opens and the released container 1 is discharged by the discharge conveyor 10.

Thus, although the container processing system 2 according to the present embodiment is intended for small lot production in terms of capacity, since the sixth rotating body R6 making up the filling apparatus 3 fills containers 1 with the beverage while intermittently stopping the gripper G6, the sterilization apparatus 5 and the washing apparatus 4 enable aseptic filling as with actual production lines for mass production.

Thus, it can be said that the container processing system 2 according to the present embodiment is suitable for providing a beverage into containers 1 in a small lot to develop a new product.

Here, according to the present embodiment, while the filling apparatus 3 serving as the main processing apparatus performs one intermittent motion, the second rotating body R2 of the sterilization apparatus 5 serving as a secondary processing apparatus can be rotated by the servomotor M, the second rotating body R2 serving as a secondary rotating body.

This allows the sterilization apparatus 5 to eject sterilization gas and hot air into the container 1 while the filling apparatus 3 is filling the container with a beverage, and thereby enables effective use of the sterilization gas ejected into the container 1.

That is, any process that has to be performed in a shorter processing time than the processing time of the filling apparatus 3 can be performed by the secondary processing apparatus.

On the other hand, during one intermittent motion in which the filling apparatus 3 fills the container with a beverage, the sterilization apparatus 5 ejects sterilization gas and hot air into the container 1 and transfers the container 1 from the upstream rotating body to the downstream rotating body.

That is, processes of the filling apparatus 3 and processes of the sterilization apparatus 5 can be performed in synchronization with each other, and in this way, apparatuses making up the container processing system 2 can perform a series of processes in synchronization with each other.

In contrast, conventionally, when aseptic filling is desired in developing a new product, there is no choice but to use a normal production line, which requires type change efforts, electricity costs, and other costs equivalent to costs for production of products for sale. Also, because production lines cannot be used for production of products for sale during testing, production losses occur during this time.

Also, according to the present embodiment, the third transfer apparatus 8 is provided between the filling apparatus 3 serving as the main processing apparatus and the washing apparatus 4 serving as a secondary processing apparatus, and the fifth rotating body R5 serving as the transfer rotating body of the third transfer apparatus 8 transfers containers from the gripper G4 of the fourth rotating body R4 of the washing apparatus 4 to the gripper G6 of the sixth rotating body R6 of the filling apparatus 3.

According to the present embodiment, the transfer rotating body makes a turn during one intermittent motion of the filling apparatus 3, causing the gripper to make a circuit. This makes it sufficient to provide a single gripper on each transfer rotating body and reduces the diameter of the rotating body. Thus, the overall configuration of the container processing system 2 can be made compact.

Note that by omitting the third transfer apparatus 8 and by placing the fourth rotating body R4 of the washing apparatus 4 and the sixth rotating body R6 of the filling apparatus 3 next to each other, the above embodiment may be configured such that the container 1 will be transferred directly from the fourth rotating body R4 to the sixth rotating body R6.

In that case, it is sufficient that at the transfer position on the fourth rotating body R4 for transfer to the sixth rotating body R6, the control unit will synchronize the moving velocity of the gripper G4 with the moving velocity of the gripper G6 on the sixth rotating body R6.

Similarly, it is possible to omit the second transfer apparatus 7 provided between the sterilization apparatus 5 and washing apparatus 4 as well as the first transfer apparatus 6 provided upstream of the sterilization apparatus 5, but in that case, one of the grippers provided next to each other needs to have an open/close mechanism.

Note that although in the above embodiment, the container 1 is gripped by the grippers G1 to G6, some of the grippers may be configured to support the bottom of the container 1 and any other known holding units may be adopted as long as the container can be transferred between rotating bodies.

What is claimed is:

1. A container processing system comprising:

a main processing apparatus; and a secondary processing apparatus, wherein the main processing apparatus includes a main rotating body equipped with a plurality of first holding units arranged at equal intervals on a perimeter to hold containers, a driving unit adapted to rotate the main rotating body while intermittently stopping the main rotating body to intermittently stop the first holding units at a plurality of stop positions, and a first processing unit provided at at least one of the plurality of stop positions and adapted to process the containers held by the first holding units, the secondary processing apparatus includes a secondary rotating body equipped with a second holding unit on a perimeter to hold a container, a servomotor adapted to drive the secondary rotating body and thereby stop the second holding unit at an appropriate processing position, and a second processing unit adapted to process the container held by the second holding unit at the processing position, and on the secondary processing apparatus, after the container held by the second holding unit of the secondary rotating body is processed by the second processing unit, the container is transferred to one of the first holding units of the main rotating body of the main processing apparatus and the first processing unit processes the container while the main rotating body rotates and moves the container intermittently, while the main processing apparatus performs one intermittent motion during which the main rotating body stops the first holding unit at a stop position in which the first processing unit is placed and the first processing unit processes the container held by the first holding unit and the main rotating body moves the first holding unit to an adjacent stop position and stops the first holding unit at the adjacent stop position, the secondary processing apparatus causes the second holding unit of the secondary rotating body to rotate once, and in a meantime, performs an operation of moving the second holding unit of the secondary rotating body from a container receiving position to a processing position for the second processing unit and stopping the second holding unit, an operation of processing the container at the processing position using the second processing unit, and an operation of moving the second holding unit of the secondary rotating body from the processing position to a container transfer position.

2. The container processing system according to claim 1, wherein:

a transfer apparatus is provided between the main processing apparatus and the secondary processing apparatus, the transfer apparatus including a transfer rotating body equipped with a third holding unit adapted to hold a container on a perimeter, and a servomotor adapted to move the third holding unit by driving the transfer rotating body; and during one intermittent motion of the main processing apparatus, the transfer apparatus performs an operation of receiving a container from a processing apparatus on an upstream side and an operation of transferring the container to a processing apparatus on a downstream side using the third holding unit of the transfer rotating body.

3. The container processing system according to claim 1, wherein during one intermittent motion of the main processing apparatus, the secondary processing apparatus moves the second holding unit of the secondary rotating body to a plurality of processing positions and stops the second holding unit at the processing positions, and performs processes at the respective processing positions with second processing units.

4. The container processing system according to claim 3, wherein:

the first processing unit of the main processing apparatus is a filling unit adapted to fill the container with a beverage at the stop position; and the second processing units of the secondary processing apparatus are a sterilization gas ejection unit provided at a processing position on an upstream side and adapted to eject sterilization gas into the container and a hot air ejection unit provided at a processing position on a downstream side and adapted to eject hot air into the container.

* * * * *